US005456583A

United States Patent [19]

Handzel

[11] Patent Number: 5,456,583

[45] Date of Patent: Oct. 10, 1995

[54] LIQUID PUMP

[75] Inventor: James J. Handzel, Minnetonka, Minn.

[73] Assignee: Graco Inc., Golden Valley, Minn.

[21] Appl. No.: 298,927

[22] Filed: Aug. 31, 1994

[51] Int. Cl.[6] ..... F04B 53/22

[52] U.S. Cl. ..... 417/454; 417/554

[58] Field of Search ..... 417/414, 360, 417/554, 555.1, 569; 92/178, 58.1; 277/121, 123, 124

[56] References Cited

U.S. PATENT DOCUMENTS

| | | | |
|---|---|---|---|
| 2,882,832 | 4/1959 | Swink | 417/454 |
| 2,883,246 | 4/1959 | Hatch | 417/554 |
| 3,075,474 | 1/1963 | Kelley | 417/554 |
| 3,510,234 | 5/1970 | Wolf | 417/554 |
| 3,684,410 | 8/1972 | Fitzgerald et al. | 417/554 |
| 3,773,441 | 11/1973 | Schertz | 417/554 |
| 3,787,149 | 1/1974 | Dane et al. | 417/554 |
| 4,214,507 | 7/1980 | Hock et al. | 92/254 |
| 4,229,149 | 10/1980 | Turner | 417/554 |
| 4,741,679 | 5/1988 | Blassingame | 417/554 |
| 4,775,303 | 10/1988 | Uska | 417/554 |
| 4,884,953 | 12/1988 | Golben | 417/379 |
| 5,040,608 | 8/1988 | Doan | 417/554 |
| 5,048,604 | 9/1991 | Vadasz | 417/454 |
| 5,297,399 | 3/1994 | Tieken | 417/555.1 |
| 5,346,037 | 9/1994 | Flaig et al. | 417/554 |

*Primary Examiner*—Richard A. Bertsch
*Assistant Examiner*—Peter G. Korytnyk
*Attorney, Agent, or Firm*—Palmatier, Sjoquist & Helget

[57] ABSTRACT

An improvement in reciprocable liquid pump construction to facilitate maintenance and repair of certain high-wear pump components without the necessity of removing the pump from the work site. The pump has a threadable and removable cylinder, intake housing, piston, piston packing and glands, piston and inlet ball checks and seats, and ball check housings.

8 Claims, 3 Drawing Sheets

LIQUID PUMP

BACKGROUND OF THE INVENTION

The present invention relates to liquid pumps; more particular, the invention relates to an improved liquid pump construction for facilitating preventive maintenance and repairs to the pump, particularly at the job site.

Liquid pumps of the type relating to this invention are typically used in industrial applications, where the pump may be installed at a location where access is limited, or where it is important to perform preventive maintenance operations or repairs without physically removing the pump from the job site. It is always desirable to be able to perform preventive maintenance or repair operations in the shortest possible time, to provide minimum interruption to the industrial activity in which the pump is associated.

Liquid pumps of the general type disclosed herein are reciprocable pumps, comprising a piston reciprocable within a cylinder, with the piston connected to an external driving source via a piston or displacement rod. The cylinder typically has a lower intake valve and an upper discharge port, and the piston has a piston valve to selectively isolate the interior of the cylinder into two compartments. The lower portion of the cylinder is immersed into a liquid container, with the intake valve beneath the liquid level in the container. During the suction stroke the piston is raised within the cylinder, closing the piston valve and opening the intake valve, thereby drawing liquid into the cylinder below the piston and expelling liquid through the discharge port above the cylinder. During the pressure stroke the piston is forced downwardly within the cylinder, closing the intake valve and opening the piston valve, thereby forcing liquid in the lower portion of the cylinder beneath the piston to flow through the piston valve into the upper portion of the cylinder above the piston and outwardly through the discharge port.

The component parts of the pump which are subject to wear are readily discernable, and it is these parts which require preventive maintenance and repair from time to time. For example, the piston packings and glands, the cylinder, the piston valve and the intake valve are all subject to relatively high wear. The need for periodic preventive maintenance of these parts is predictable, and the need for occasional repair is expected. Therefore, it is desirable to design the pump so that access to these parts can be made quickly, and without requiring disassembly of substantial portions of the pump to achieve this access. It is a principal object of the present invention to provide a pump construction which permits quick and efficient access to these component parts, particularly without requiring removal and disassembly of the entire pump to accomplish preventive maintenance and repair operations, and without the requirement of removing the entire pump from its mounting or application.

SUMMARY OF THE INVENTION

The invention comprises a reciprocable pump having a one-piece removable cylinder with a separately-removable intake valve compartment, wherein the piston and piston valve are threadably removable from the piston displacement rod, and the piston packings and glands are threadably removable from the piston; wherein all of the foregoing components may be removed from the pump without disturbing the mounting position of the pump, or requiring removal of the pump from the job site. The piston check valve and the intake check valve can both be serviced upon removal of the intake valve compartment and the piston. All of the components are removable and accessible from the lower end of the pump without removing the piston displacement rod or disconnecting it from the driving source.

It is a feature and advantage of the present invention to provide a pump wherein the high-wear parts may be removed from the lower end of the pump without disengaging the pump from its driving source.

It is another feature and advantage of the invention to provide a pump having a one-piece cylinder, a lower intake valve compartment, a piston and piston valve assembly, and piston packings and glands which are all threadably interconnected for ease of access to each component for maintenance and repair.

The foregoing and other objects, advantages and features will become evident from the following specification and claims, and with reference to the drawings.

DESCRIPTION OF THE PREFERRED EMBODIMENT

Figure 1:
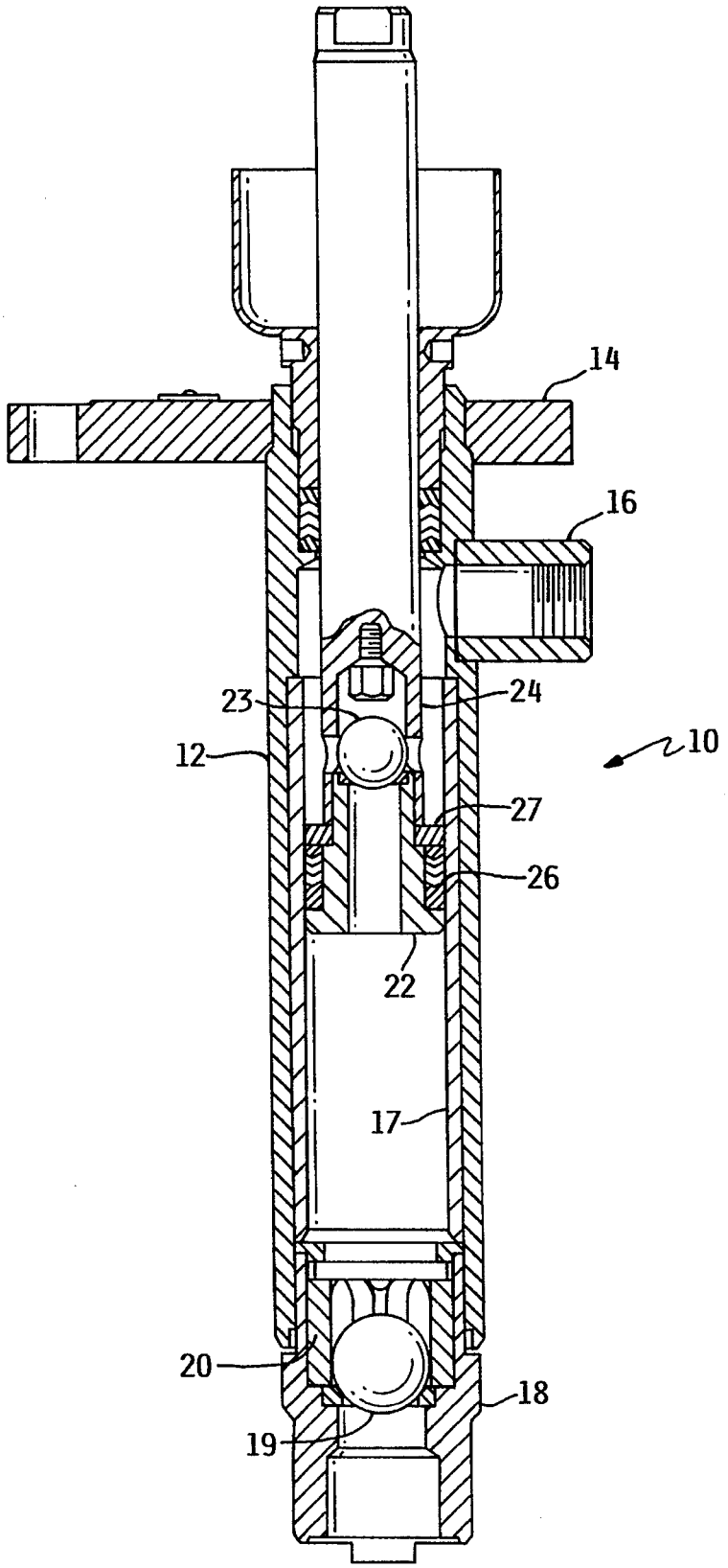
FIG. 1 (PRIOR ART)
FIG. 1 shows a cross-section view of a prior art liquid pump.

Referring first to FIG. 1, there is shown a cross-section view of a prior art pump, illustrating the disadvantageous features relating to assembly and disassembly of the high-wear parts in the pump. The pump 10 has a cylinder housing 12 which is affixed to a mounting bracket 14. Mounting bracket 14 may be attached to a driving motor, which is attached to a wall or floor mounting base. A discharge port 16 is attached to cylinder housing 12, providing access into the interior of the cylinder. An intake compartment 18 is threadably attached to the lower end of cylinder housing 12, and is threadably secured to clamp an intake valve assembly 20 and a cylinder sleeve 17 within the cylinder housing 12. Cylinder sleeve 17 is necessarily very tightly fitted against the interior surface of cylinder housing 12. Piston 22 is threadably secured to piston rod 24, and piston ball check 23 is confined within a passage in the end of piston rod 24. A bolt 25 is threaded into piston rod 24 at the bottom of the passage, to provide an adjustable stop to limit the movement of ball check 23. The piston packing and gland assembly 26 is clamped between an outer shoulder of piston 22 and a spacer 27, which abuts against the lower end of piston rod 24.

The removal of the piston 22, piston ball check 23, packing and gland assembly 26, and cylinder sleeve 17 requires removal and disassembly of pump 10. For example, the piston 22, packing and gland assembly 26 and piston ball check 23 can only be removed by removal of piston rod 24 through the bottom of cylinder housing 12. Cylinder sleeve 17 can only be removed and replaced by disassembly of the entire pump 10, so that a removal punch can be inserted through the top opening of the cylinder housing 12 and sleeve 17 can be forced out through the bottom opening of cylinder housing 12. These operations are major maintenance operations, completely disabling the pump during the maintenance down time.

Figure 2:
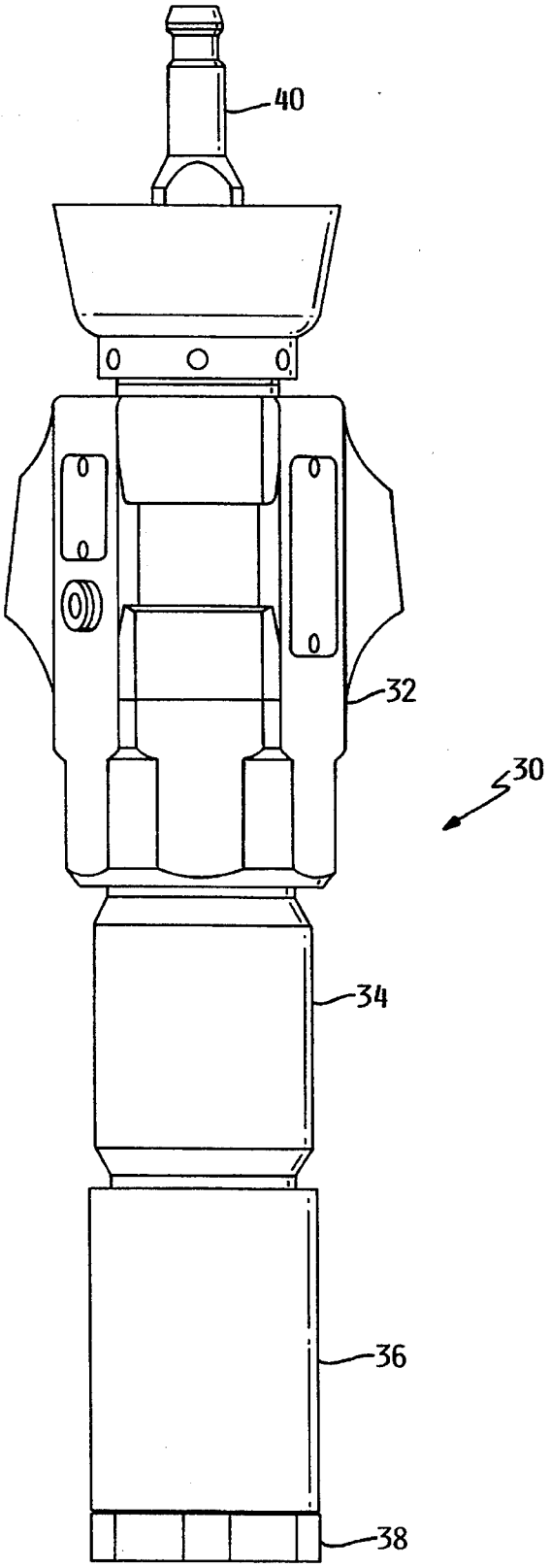
FIG. 2 shows an elevation view of the present invention.

FIG. 2 shows an elevation view of a pump 30 constructed according to the teachings of the present invention. A pump housing 32 may be affixed to a driving motor or other suitable mounting base, A cylinder 34 is threadably attached to pump housing 32, and an intake housing 36 is threadably attached to cylinder 34. An inlet ball seat assembly 38 is threadably attached to intake housing 36. A piston rod 40 extends upwardly from pump housing 32, and is connectable to a suitable reciprocable driving source.

Figure 3:
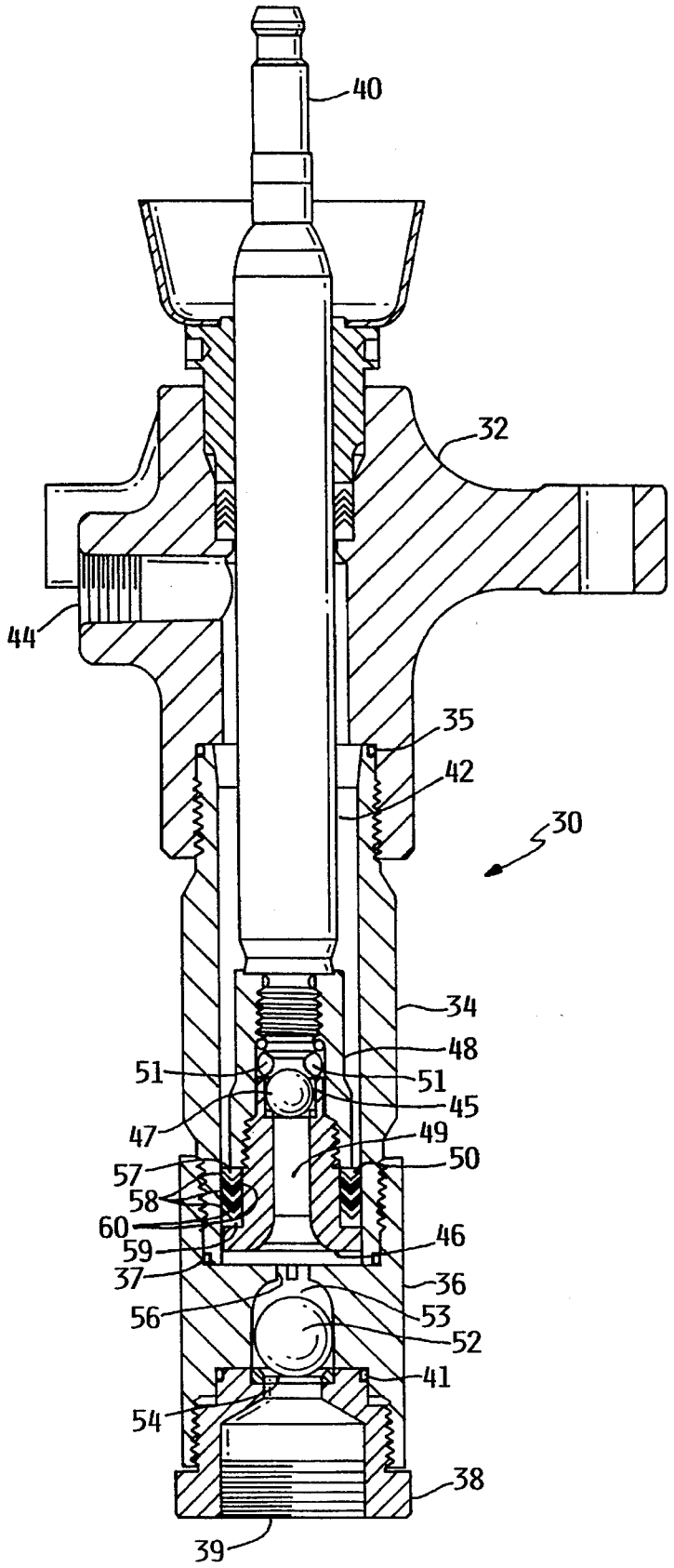
FIG. 3 shows a cross-section view of the present invention, showing the advantageous features described herein.

FIG. 3 shows a cross-section view of pump 30. An interior cylinder chamber 42 is formed in the space between piston rod 40 and pump housing 32 and cylinder 34, and chamber 42 communicates with an outlet passage to a discharge port 44. Cylinder 34 is preferably made from a material such as stainless steel, with an interior surface machined smoothly for guiding a piston 46. An O-ring 35 is preferably fitted about the upper end of cylinder 34 to sealably engage against pump housing 32. The lower end of cylinder 34 is threadably engaged into an intake housing 36, and an O-ring 37 is preferably fitted about the lower end of cylinder 34 to sealably engage against intake housing 36.

A piston 46 is threadably attached to a ball check housing 48, and ball check housing 48 is threadably attached to the end of piston rod 40. Piston packing and gland assembly 50 is clamped between an outer shoulder of piston 46 and ball check housing 48. A piston ball check 47 is contained between piston 46 and the end of piston rod 40, to selectively open and close a passage 49 leading between the lower end of piston 46 and the interior of ball check housing 48. Four tabs 45 extend upwardly from piston 46 to confine ball check 47, with spaces between the respective tabs 45 to permit liquid flow therebetween. At least one cross passage 51 leads between the interior of ball check housing 48 and chamber 42. Therefore, liquid flow through piston passage 49 and cross passages 51 is possible when ball check 47 is raised from its seat on piston 46.

The packing and gland assembly 50 is preferably made from a stacked arrangement of ring-shaped components. A male gland member, preferably made from stainless steel, abuts against the lower edge of ball check housing 48. A female gland member 59, preferably made from stainless steel, abuts against a lower shoulder of piston 46. A stacked arrangement of alternating layers of plastic seals 58 and leather packings 60 is clamped between male and female gland members 57 and 59. Each of the plastic seals 58 and the leather packings 60 has a V-shaped cross section, and the lower side of male gland 57 and the upper side of female gland member 59 are each complementary-shaped to engage the V-shaped cross section.

An intake ball check 52 is movable in a chamber 53 formed between seat 54 and ball stop 56. Ball stop 56 is preferably formed by casting and machining several radial ribs in intake housing 36, each rib extending inwardly sufficiently far to confine ball check 52 within chamber 53, while permitting liquid flow from the lower inlet 39 to freely pass ball check 52 by flowing through the spaces between the several radial ribs which form ball stop 56. Intake housing 36 is preferably formed of stainless steel, as is inlet ball seat assembly 38.

Inlet ball seat assembly 38 is threadably attached to intake housing 36, and an O-ring 41 is sealably confined between the upper edge of ball seat assembly 38 and intake housing 36. Seat 54 is preferably made from tungsten carbide having superior wear characteristics. Inlet 39 may be threaded to receive a screen assembly or other inlet attachment, depending upon the particular application or work site configuration for pump 30.

During the suction stroke of piston 46, ball check 52 is raised from seat 54, and liquid is drawn into the chambers 52 and 42 in the region within and below piston 46. Ball check 47 is held against its seat on piston 46. Liquid in the upper portion of cylinder chamber 42 (above piston 46) is forced outwardly through discharge port 44. During the pressure stroke of piston 46 the ball check 52 is held against seat 54, and ball check 47 is raised from its seat. Liquid is transferred from the lower portion of cylinder chamber 42, through passage 49 in piston 46, into the upper portion of cylinder chamber 42 via cross passages 51.

Ball check 52 and seat 54 may be removed for service by threadably removing inlet ball seat assembly 38. Piston 46 may be removed for service by threadably removing cylinder 34, and then threadably removing piston 46 from ball check housing 48; packing and gland assembly 50 may be removed for service at the same time. Ball check 47 may also be removed for service by threadably removing piston 46 from the lower end of ball check housing 48. Cylinder 34 may be removed for service by threadably removing it from intake housing 36. It should be noted that all of the foregoing component parts may be removed for service without disconnecting pump housing 32 from its motor and mounting base, and without disconnecting piston rod 40 from its reciprocable drive source. Therefore, maintenance and repair of all the foregoing component parts may be accomplished while the pump 30 remains at the job site, and remains connected to its driving source and to the liquid delivery conduits connected to discharge port 44.

What is claimed is:

1. In a reciprocable liquid pump apparatus having a pump housing adapted for fixed installation at a work site, and a plurality of component parts requiring periodic maintenance and repair, the improvement in pump construction to facilitate component part maintenance and repair, comprising:

a) a reciprocable piston rod extending through said pump housing along an axis, said piston rod having a threaded lower end;

b) a cylinder threadably attached to said pump housing concentrically about said piston rod, said cylinder having threaded upper and lower ends;

c) an intake housing threadably attached to said cylinder threaded lower end, said intake housing having a passage therethrough and a lower threaded end;

d) an inlet ball seat assembly threadably attached to the lower threaded end of said intake housing, said inlet ball seat assembly having a removable ball seat;

e) a ball check loosely confined between said intake housing and said inlet ball seat assembly;

f) a ball check housing threadably attached to the lower threaded end of said piston rod, said ball check housing having at least one passage therethrough, and said ball check housing further having a threaded lower end;

g) a piston threadably attached to said ball check housing threaded lower end, said piston having a passage therethrough along said axis, with a ball check seat at the upper end of said passage, h) a piston ball check loosely confined within said ball check housing and between said piston rod and said piston;

i) a piston packing and gland assembly fitted about said piston and clamped between said piston and said ball check housing;

whereby all of said parts b) through i) may be connected and disconnected to said pump housing at said work site without moving said pump housing.

2. The apparatus of claim 1, further comprising an inlet ball seat assembly threadably attached to said intake housing, said ball seat assembly having a ball seat sized to engage said inlet ball check.

3. The apparatus of claim 2, wherein said intake housing further comprises a ball stop means for limiting the movement of said inlet ball check along said axis.

4. The apparatus of claim 1, wherein said cylinder comprises a one-piece construction made from stainless steel.

5. The apparatus of claim 4, wherein said piston further comprises a plurality of upstanding tabs positioned to confine said piston ball check.

6. The apparatus of claim 4, where said piston packing and gland assembly comprises a stacked arrangement of alternating leather packing and plastic seals, confined between an upper and lower gland.

7. The apparatus of claim 6, where each of said leather packing and said plastic seals have a V-shaped cross section, and said upper and lower glands have respective complementary cross sections to engage said V-shaped cross section.

8. The apparatus of claim 7, where said upper and lower glands are each constructed of stainless steel material.

* * * * *